United States Patent [19]

Hofbauer et al.

[11] 4,372,257

[45] Feb. 8, 1983

[54] DRIVE AGGREGATE FOR A HEAT PUMP

[75] Inventors: Peter Hofbauer; Erich Gaschler; Cornelia Schwarz, all of Wolfsburg, Fed. Rep. of Germany

[73] Assignee: Volkswagenwerk AG, Wolfsburg, Fed. Rep. of Germany

[21] Appl. No.: 125,537

[22] Filed: Feb. 28, 1980

[30] Foreign Application Priority Data

Mar. 5, 1979 [DE] Fed. Rep. of Germany ..... 2908432

[51] Int. Cl.[3] ..... F02B 17/00

[52] U.S. Cl. ..... 123/68; 417/364

[58] Field of Search ..... 123/59 EC, 68; 417/364, 417/237, 454, 569, 571

[56] References Cited

U.S. PATENT DOCUMENTS

| | | | |
|---|---|---|---|
| 1,992,400 | 2/1935 | Smith | 417/237 |
| 2,500,366 | 3/1950 | Lamberton | 417/364 |
| 4,255,090 | 3/1981 | Pratt | 417/237 |

FOREIGN PATENT DOCUMENTS

| | | | |
|---|---|---|---|
| 39716 | 5/1909 | Austria | 123/68 |
| 599038 | 10/1959 | Italy | 417/571 |
| 404369 | 1/1934 | United Kingdom | 417/364 |

*Primary Examiner*—Craig R. Feinberg
*Attorney, Agent, or Firm*—Spencer & Kaye

[57] ABSTRACT

A drive aggregate for a heat pump includes a cylinder block defining cavities for forming at least one cylinder of an internal combustion engine and at least one cylinder of a compressor driven by the engine; a common crankshaft passing through the cylinder block for serving both the engine and the compressor; and a plurality of bearings mounted in the cylinder block and supporting the crankshaft. The cavities all have the same height dimension. There is further provided a valve plate sealingly secured in each cavity which forms a compressor cylinder. The valve plate which defines an end of the compressor cylinder formed by the respective cavity, is recessed with respect to the height of the cavity in which it is situated.

4 Claims, 2 Drawing Figures

DRIVE AGGREGATE FOR A HEAT PUMP

BACKGROUND OF THE INVENTION

This invention relates to a drive aggregate which is associated with a heat pump and which includes a compressor and an internal combustion engine driving the compressor. The engine and the compressor are combined into a structural unit by a common cylinder block which accommodates the compressor cylinders and the engine cylinders and which further has bearings for a common crankshaft, which may be a one-piece or a multi-piece component.

A drive aggregate of the above-outlined compact structure disclosed in U.S. patent application by Hofbauer et al, Ser. No. 84,137, filed Oct. 12th, 1979 has the advantage that a single cylinder block mass-manufactured for internal combustion engines may be used for both the engine and the compressor. It is, understandably, desirable to use, in the zone of the compressor, a cylinder head which too, is such a mass-manufactured component. Consequently, the use of a one-piece cylinder head for the entire heat pump drive aggregate is sought. These desiderata require, however, that the structure of the cylinder head for accommodating the valves of the internal combustion engine have no influence on the operation of the compressor because otherwise substantial subsequent alterations would be required in that zone of the cylinder head which covers the cylinder or the cylinders of the compressor.

SUMMARY OF THE INVENTION

It is an object of the invention to provide an improved heat pump drive aggregate in which a conventional cylinder head mass-manufactured for internal combustion engines may find application without requiring substantial subsequent work of alteration in the zone of the compressor.

This object and others to become apparent as the specification progresses, are accomplished by the invention, according to which, briefly stated, the cavities provided in the cylinder block for all the cylinders have the same height and further, in the cavity for forming the compressor cylinder there is sealingly secured a valve plate which forms an end wall of the compressor cylinder and which supports intake and discharge valves of the compressor.

Thus, according to the invention, for each compressor cylinder there is arranged a separate valve plate in that cavity of the cylinder block which is utilized for forming the compressor cylinder. Such an arrangement makes a subsequent alteration work in the compressor zone of the common cylinder head unnecessary, because the configuration provided there—generally by casting—for use in an internal combustion engine may be retained. Care has to be taken only that in the compressor zone too, the cylinder head ensures a sealed closure even in the absence of the conventional valves for the engine cylinders. For this purpose, it is generally sufficient to omit those valve stem guide passages which are normally present in the compressor zone of the cylinder head were the latter conventionally used as a component of an internal combustion engine.

DESCRIPTION OF THE PREFERRED EMBODIMENTS

Figure 1:
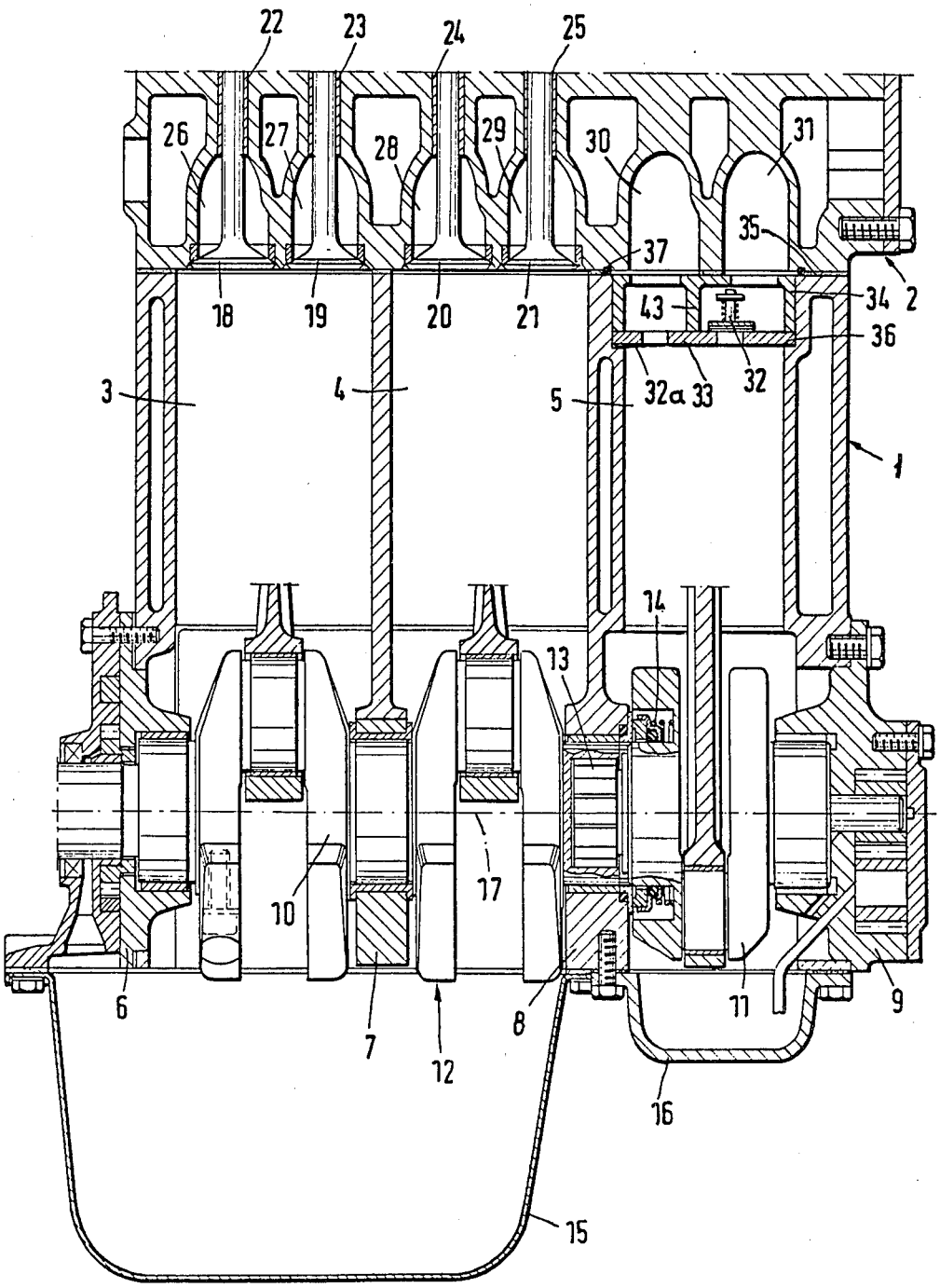
FIG. 1 is a sectional elevational view of a heat pump drive aggregate according to a preferred embodiment of the invention.

Turning first to FIG. 1, there is shown a cylinder block generally indicated at 1 and a cylinder head generally indicated at 2. In the illustrated embodiment, the cylinder block contains two cylinders 3 and 4 of an internal combustion engine and one cylinder 5 of a compressor. Further, the cylinder block 9 supports, by means of four bearings 6, 7, 8 and 9, a common crankshaft 12 formed of crankshaft portions 10 and 11. Advantageously, the coupling 13—which firmly connects the two crankshaft portions with one another and which is formed of cooperating inner and outer teeth—and components of a slide ring seal 14 are situated inside the crankshaft bearing 8; this renders an axial prolongation of the structure unnecessary. It is thus seen that the cylinder block 1 and the cylinder head 2 combine into a structural unit the compressor and the internal combustion engine which drives the compressor.

Underneath the crankshaft 12 there are arranged two separate oil pans 15 and 16 which ensure that the oil circuits for the internal combustion engine on the one hand and the compressor on the other hand are maintained separate from one another.

The cylinders 3 and 4 of the internal combustion engine have a predetermined height, that is, a predetermined dimension perpendicularly to the crankshaft axis 17. In the zone of the engine cylinders 3 and 4 there are shown the conventional intake and discharge valves (engine valves) 18, 19, 20 and 21, together with associated valve stem guide passages 22, 23, 24 and 25 provided in the cylinder head 2. The intake and discharge ports 26, 27, 28 and 29 associated with the cylinders 3 and 4 of the internal combustion engine are also provided in the cylinder head 2.

Turning now to the compressor side of the aggregate, it is seen that with the exception of omitting the valve stem guide passages, no changes have been made in the cylinder head 2 in the zone of the compressor cylinder 5. The ports 30 and 31 are of the same configuration as those in the zone of the engine cylinders and serve for the supply and withdrawal of the coolant of the heat pump. The compressor valves 32, 32*a* on the other hand, are arranged on a valve carrier plate 33 which is secured in a sunken, recessed manner in the cylinder block cavity which forms the compressor cylinder 5. Stated differently, the valve carrier plate 33 is spaced from the cylinder head 2 and from the top end of the compressor cylinder 5 and is thus, in its entirety, situated within the compressor cylinder 5. For mounting the valve carrier plate 33 there serves an insert 34, whose upper boundary extends in the plane of a cylinder head gasket 35 and which presses the valve carrier plate 33 against an inwardly extending shoulder 36 of the cavity wall. This may be achieved by the pressing force supplied by the cylinder head or by pressfitting the insert into the cylinder block. A septum 43 extending between the valve carrier plate 33 and the cylinder head gasket 35 ensures a sealed separation of the intake and discharge ports 30, 31 from one another. The cylinder head gasket 35 is, in the zone of the compressor, reinforced by an O-ring 37.

Figure 2:
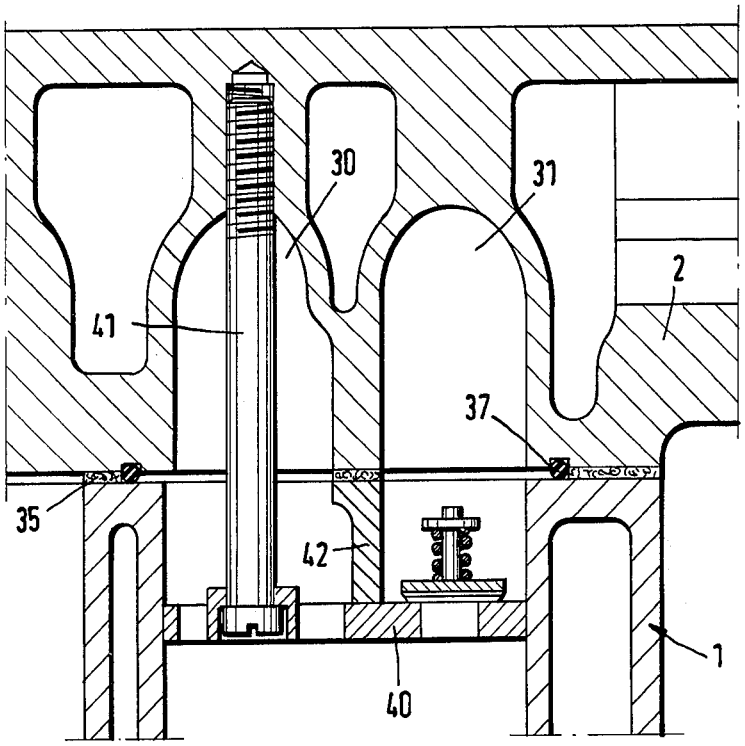
FIG. 2 is a sectional elevational view, on an enlarged scale, of modified details of a second preferred embodiment of the invention.

Turning now to the embodiment illustrated in FIG. 2, there is shown a recessed valve carrier plate 40 which, in contradistinction to the arrangement shown in FIG. 1, is held in the cylinder head 2 by means of a bolt 41. The bolt 41 is screwed in that part of the cylinder head 2 which would otherwise serve to accommodate a valve stem guide passage. A septum 42 extending between the valve carrier plate 40 and the cylinder head gasket 35 ensures a sealed separation of the two ports 30 and 31 from one another.

It is a common characteristic of both described embodiments that for the cylinder block and also for the cylinder head conventionally mass-manufactured components of internal combustion engines may be utilized without requiring appreciable alterations. Further, the valves for the compressor are so arranged according to the invention that no additional space is required therefor.

It is further feasible—departing from the illustrated embodiments—to arrange the valve carrier plate eccentrically, that is, for example, to make the shoulder 36 in FIG. 1 deeper towards the right than towards the left while retaining an appropriate cross section for sealing. For accommodating larger valve cross sections, it may be expedient to provide, in the wall of the compressor cylinder, depressions serving as ports. If several intake and discharge valves are provided for the compressor cylinder 5, the septum 43 in FIG. 1 and the septum 42 of FIG. 2 should have such a course that all intake valves are sealingly separated from all discharge valves of the compressor cylinder.

It will be understood that the above description of the present invention is susceptible to various modifications, changes and adaptations, and the same are intended to be comprehended within the meaning and range of equivalents of the appended claims.

What is claimed is:

1. In a drive aggregate for a heat pump, including a cylinder block defining cavities for forming at least one cylinder of an internal combustion engine and at least one cylinder of a compressor driven by the engine; a common crankshaft passing through said cylinder block for serving both the engine and the compressor; and a plurality of bearings mounted in said cylinder block and supporting said crankshaft; the improvement wherein said cavities all have the same height dimension; further comprising a valve carrier plate sealingly secured in each cavity which forms a compressor cylinder; a compressor valve supported by said valve carrier plate; said valve carrier plate defining an end of the compressor cylinder formed by the respective cavity; a cylinder head secured to said cylinder block and extending over all said cylinders; each compressor cylinder having a top end oriented towards said cylinder heads; said valve plate being spaced from said cylinder head and from the top end of the respective compressor cylinder and being situated in its entirety within a respective said compressor cylinder; engine valves associated solely with each said engine cylinder and being mounted in said cylinder head; said cylinder head having a plurality of predetermined locations adapted to accommodate valve guide passages in the zone of each cylinder; means defining throughgoing valve guide passages solely in the predetermined locations associated with the engine cylinders for accommodating and guiding parts of said engine valves, whereby said predetermined locations of said cylinder head in the zone of each compressor cylinder being void of throughgoing valve guide passages for sealing said cylinder head in the zone of each said compressor cylinder.

2. A drive aggregate as defined in claim 1, further wherein said cylinder head defines with said cylinder block a parting plane; further wherein each cavity forming a compressor cylinder is bounded by wall means including an inwardly extending shoulder; and an insert engaging said valve carrier plate and extending to said parting plane; said insert pressing said valve carrier plate against said shoulder.

3. A drive aggregate as defined in claim 1, further comprising mounting means for securing said valve carrier plate to said cylinder head.

4. A drive aggregate as defined in claim 3, further wherein said mounting means comprises at least one bolt passing through said valve carrier plate and being held in one of said predetermined locations.

* * * * *